US005362202A

United States Patent [19]

Derouet et al.

[11] Patent Number: 5,362,202

[45] Date of Patent: Nov. 8, 1994

[54] TURBOMACHINE EQUIPPED WITH MEANS FOR ADJUSTING THE PLAY BETWEEN THE STATOR BLADES AND THE ROTOR OF A COMPRESSOR

[75] Inventors: Patrick R. J. Derouet, Soignolles en Brie; Philippe M. Paris, le Mee sur Seine, both of France

[73] Assignee: Societe Nationale d'Etude et de Construction de Moteurs d'Aviation "Snecma", Paris, France

[21] Appl. No.: 130,177

[22] Filed: Oct. 1, 1993

[30] Foreign Application Priority Data

Oct. 7, 1992 [FR] France ..... 92 11860

[51] Int. Cl.[5] ..... F01D 17/14

[52] U.S. Cl. ..... 415/148; 415/150; 415/159; 415/173.2

[58] Field of Search ..... 415/148, 150, 151, 155, 415/157, 159, 162, 173.1, 173.2, 129, 130

[56] References Cited

U.S. PATENT DOCUMENTS

| | | | |
|---|---|---|---|
| 3,861,823 | 1/1975 | Serovy | 415/151 |
| 4,470,256 | 9/1984 | Palmer | 415/150 |
| 4,579,507 | 4/1986 | Corrigan et al. | 415/150 |
| 4,657,481 | 4/1987 | Mowill | 415/151 |
| 5,035,573 | 7/1991 | Tseng et al. | 415/173.2 |
| 5,049,033 | 9/1991 | Corsmeier et al. | 415/127 |
| 5,096,374 | 3/1992 | Sakai et al. | 415/150 |
| 4,737,0971 | 4/1988 | Horn, Jr. | 415/148 |

FOREIGN PATENT DOCUMENTS

| | | |
|---|---|---|
| 2603340 | 3/1988 | France . |
| 2036885 | 7/1980 | United Kingdom . |

*Primary Examiner*—John T. Kwon

*Attorney, Agent, or Firm*—Oblon, Spivak, McClelland, Maier & Neustadt

[57] ABSTRACT

The adjustment of the play separating the stators and the rotor is effected automatically and jointly with adjustment of the phase angle of the stators. For each startor, at least one slug is used, the slug being mounted for sliding in an oblique groove of a bush integral with the stator. A bush, groove and slug arrangement can also be provided for an adjustable stop on the starter to adjust the play between a free extremity of the rotor blade and the adjustable stop on the stator. Pivoting of each stator provokes a systematic modification of the play.

4 Claims, 3 Drawing Sheets

TURBOMACHINE EQUIPPED WITH MEANS FOR ADJUSTING THE PLAY BETWEEN THE STATOR BLADES AND THE ROTOR OF A COMPRESSOR

FIELD OF THE INVENTION

The invention concerns turbomachines in which at least one compressor is equipped with blades or fins of the stator and known as "rectifiers" whose angle of orientation, that is the phase angle, is adjustable. In particular, it concerns modern aeronautical turbomachines and more specifically the first stages of the axial high pressure compressor.

BACKGROUND OF THE INVENTION

With reference to FIG. 1, a high pressure compressor of a modern turbomachine used in aeronautics for the propulsion of aircraft includes a stator 2 and a rotor 8 rotating around the main axis 4 of the turbomachine. The first stages 3 of these axial compressors are equipped with stator blades 1 with a variable phase angle. In fact, these rectifiers are mounted rotating in bushes 13 fixed to the stator 2. In other words, the orientation of these stator blades around an axis perpendicular and intersecting with the spin axis 5 of the rotor 8 is adjustable during operation. Thus, for each stator blades 1, there is a crank 7 mounted for pivoting around the spin axis 10 of each rectifier 1. The pivoting of each of these cranks 7 obtained by means of control means 11 allows for adjustment of the phase angle of each of the stator blades 1.

The search for improved performances of these turbomachines concerns efficiency and obtaining a maximum thrust. This search has rendered these motors extremely sensitive as regards their thermic state. So as to reduce this sensitivity, particular attention is paid to secondary phenomena appearing during functioning of the machine. One particular phenomenon is leaking or an imperviousness defect and this has led to finding a way to fully control play on functioning between the fixed portions (for example, the stator blades) and the rotating portions (such as the rotor). These problems are encountered more particularly between the extremity of the stator blades and the external portion of the rotor of the compressor which is sometimes equipped with an imperviousness system commonly known as a "licking" system.

French patent No. 2 603 340 describes a turbomachine comprising a device for adjusting the play of a labyrinth gasket intervening between the rotor and the stator of a compressor so as to obtain an alignment of the main vein of the gases flowing inside the compressor. This system acts at the end of the stator blade whose phase angle is adjustable. On the other hand, this play adjustment device is independent of the phase adjustment.

The present invention is able to accurately and automatically adjust the radial play between the stator blade and the rotor of the compressor during functioning of the turbomachine.

SUMMARY OF THE INVENTION

To this effect, the main object of the invention is to provide a turbomachine including at least one axial compressor equipped with a specific number of first compression stages formed by rotor blades and the blades of a stator and mounted orientation-adjustable via the rotation of each of these stators around an axis perpendicular and intersecting with the spin axis of the rotor, the extremities of the stators being located separated from the rotor by a first specific play.

According to the invention, means are used to adjust the first play (between the stators and the rotor) according to the phase angle of the stators.

The orientation of these stators is preferably effected by a spindle mounted pivoting with respect to the stator with the aid of a first bush and a first crank integral with the spindle, the means for adjusting the first play including for each stator:

—a first specific number of oblique grooves, for example helical with respect to the axis of the stator, in a first bush;

—a given number of slugs integral with the axis of the stator and perpendicular to the spin axis of this stator and each penetrating into a groove so that one rotation of the crank provokes a longitudinal movement of the stator along their axis.

The first crank preferably has a link hole at its extremity, thus enabling it to be a pivoting and sliding link with a control axis of the control means.

With one extremity of each blade of the rotor being located separated from the stator by a second specific play, one variant of the invention provides means for adjusting the second play between the blades and the stator.

The means for adjusting the second play preferably include:

—one second bush integral with the stator and bearing a second specific number of oblique grooves, that is helical with respect to the axis of a hole of the second bush;

—a stop mounted-sliding in the hole of the second bush and having a specific given number of slugs perpendicular to the axis of the hole, each penetrating into a groove, one lower extremity placed opposite a set of blades and, at one upper extremity, a second crank having a hole allowing it to be a pivoting sliding link with the control axis of the control means.

BRIEF DESCRIPTION OF THE DRAWINGS

The invention and its technical characteristics shall be more readily understood from a reading of the following description with reference to the accompanying FIGS. 2 and 3.

DESCRIPTION OF THE PREFERRED EMBODIMENTS

Figure 1:
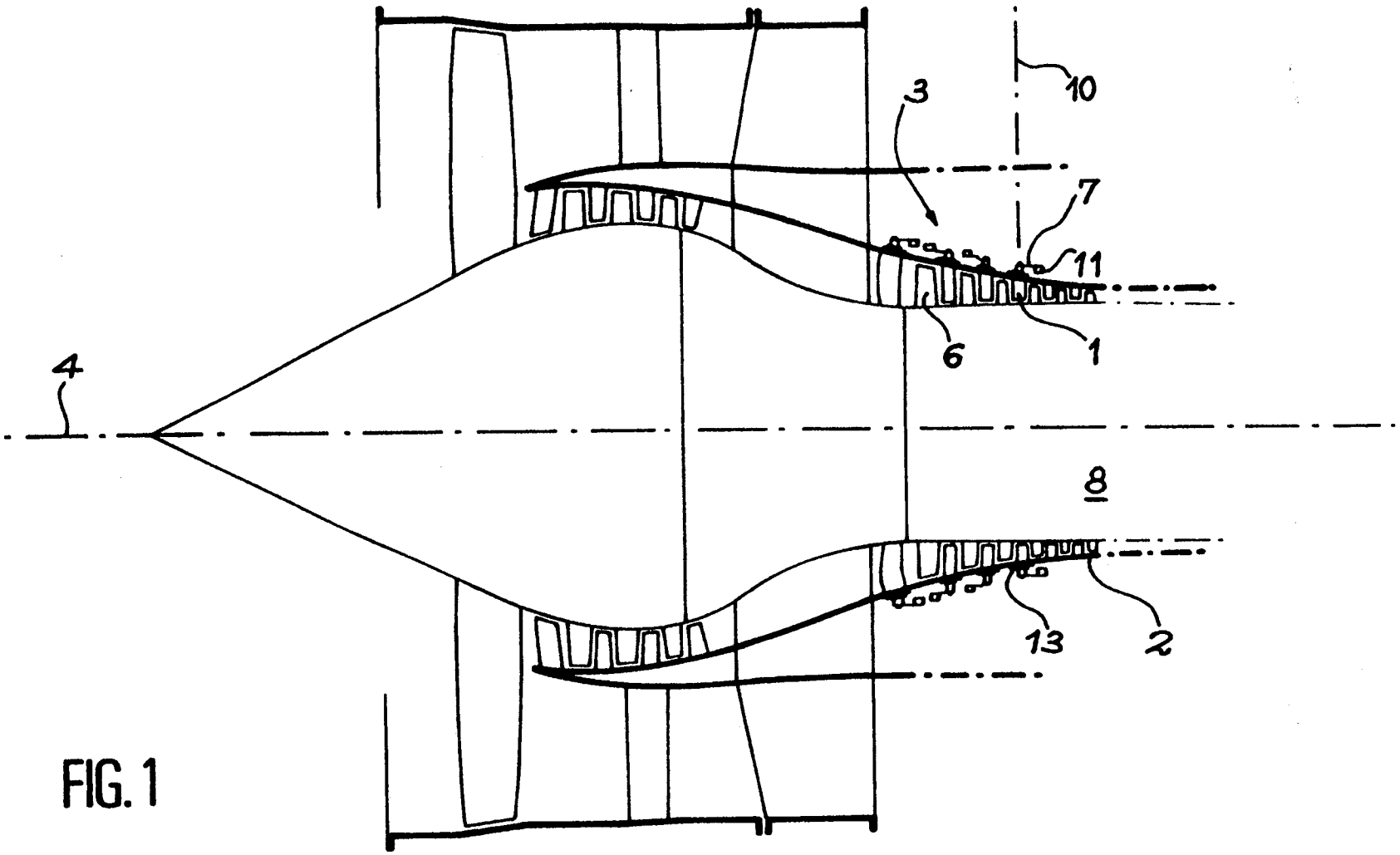
FIG. 1, already described, represents the portion of a turbomachine applicable to the invention.
Figure 2:
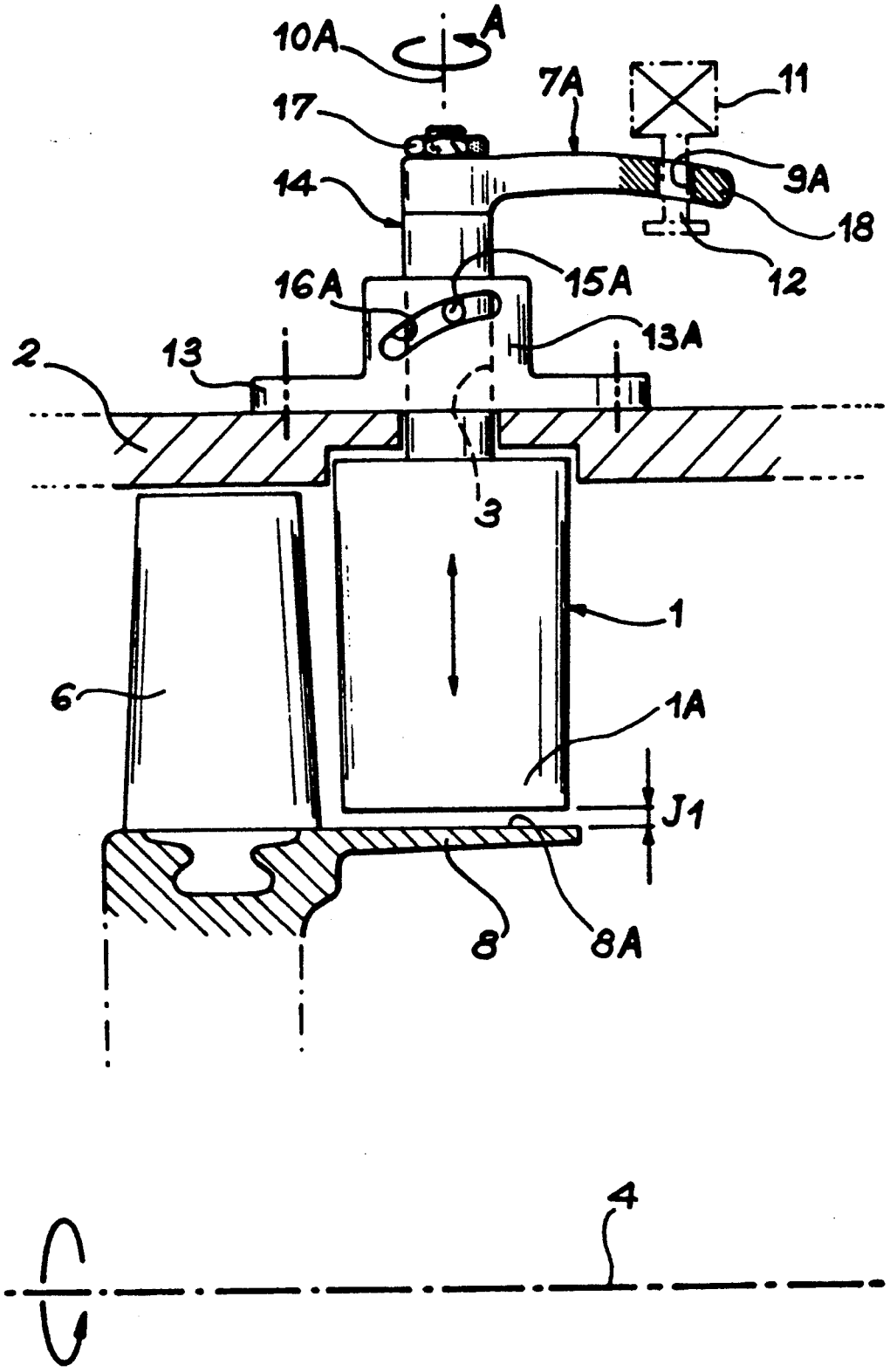
FIG. 2 is a partial cutaway view of the portion of a turbomachine in which the invention is installed.

FIG. 2 shows the spin axis 4 of the rotor 8 of the turbomachine, an axis with respect to which a half-cut represents a stator blade 1 placed opposite the rotor 8. This stator 1 is a blade mounted pivoting around a spin axis 10A perpendicular and intersecting with respect to the spin axis 4 of the rotor 8. This rotation modifies the phase angle A of this stator and also modifies the section of the gas vein between the stators 1 of the stator 2 and the blades 6 of the rotor 8, thus modifying the operating conditions of the turbomachine compressor.

This stator 1 is mounted for rotating with respect to the stator 2 by means of spindle 14 centered on the spin axis 10A of the stator 1. This spindle 14 is mounted for rotating in a hole 19A of a first bush 13A secured to the stator 2. A first crank 7A is mounted integral with this spindle 14 by means of an adjusting nut 17 screwed onto the spindle 14.

Thus, by activating the extremity 18 of the first crank 7A, the phase angle A of the stator is modified around its spin axis 10A.

Each stator 1 of a given stage of the compressor possesses this system for adjusting the phase angle A. Each first crank 7A of a given compressor stage is activated by a control device 11 common to every stage and being placed around the unit of the compressor.

A first play or distance JI is shown between the extremity 1A of the stator 1 and the external surface 8A of the rotor 8 which is opposite the stator 1. According to the invention, adjustment means are provided to adjust this first play or distance J1 in relation to the adjustment of the phase angle A of the stators 1.

These adjustment means are mainly formed for each rectifier 1 of one or several grooves 16A in the first bush 13A, said grooves being oblique with respect to the spin axis 4 of the rotor, that is not perpendicular to the spin axis 10A of the stator 1. For example, each groove 16A is a slit having a passage assimilated with a helical portion around the spin axis 10A. As regards these grooves, it is also possible to envisage any shapes so as to obtain different displacements of the bush 13A. Moreover, this constitutes a device for adjusting or modifying this movement according to the rotation of the bush 13A.

Secondly, each spindle 14 of each stator 1 has a given first number N1 of slugs 15A corresponding to the number N1 of grooves 16A made in the first bush 13A. Each slug 15A has an outer diameter slightly smaller than the width of the grooves 16A. These slugs 15A are fixed in the spindle 14 perpendicular to the spin axis 10A of the stator 1.

Owing to this, rotation of the unit of the stator 1 and its spindle 14 around the spin axis 10A modifies, not merely the phase angle A of the stator 1 with respect to the stator 2 and the rotor 8, but also provokes a sliding of the spindle 14 in the hole 3 of the first bush 13A and thus modifies the first play J1 separating the extremity 1A of the stator 1 from the external surface 8A of the rotor 8.

Thus, when for reasons of acquiring turbomachine efficiency, it is decided to act on the phase angle A of the stators 1 by means of the first crank 7A, this action then automatically affects the first play J1. This play is thus adjusted accurately and automatically. The shape and position of the first grooves 16A are calculated so that the first play J1 evolves according to the phase angle A so as to retain the maximum efficiency of the compressor according to the speed of rotation of the rotor 8. This means that the first play J1 shall always have a minimum value, having regard for the value of the mounting play not highlighted on FIG. 2.

The number N1 of the first grooves 16A in the first bush 13A is preferably three, this example simply indicating the preferred embodiment of the invention.

Control of the first play J1 and the phase angle A is obtained by control means 11 whose action is symbolized by a control spindle 12 traversing the hole 9 of the extremity 18 of the first crank 7A. This control spindle 12 is provided with a minimum length so as to enable the first crank 7A to slide around this control spindle 12, having regard for the displacement of the spindle 14 along the spin axis 10A.

Figure 3:
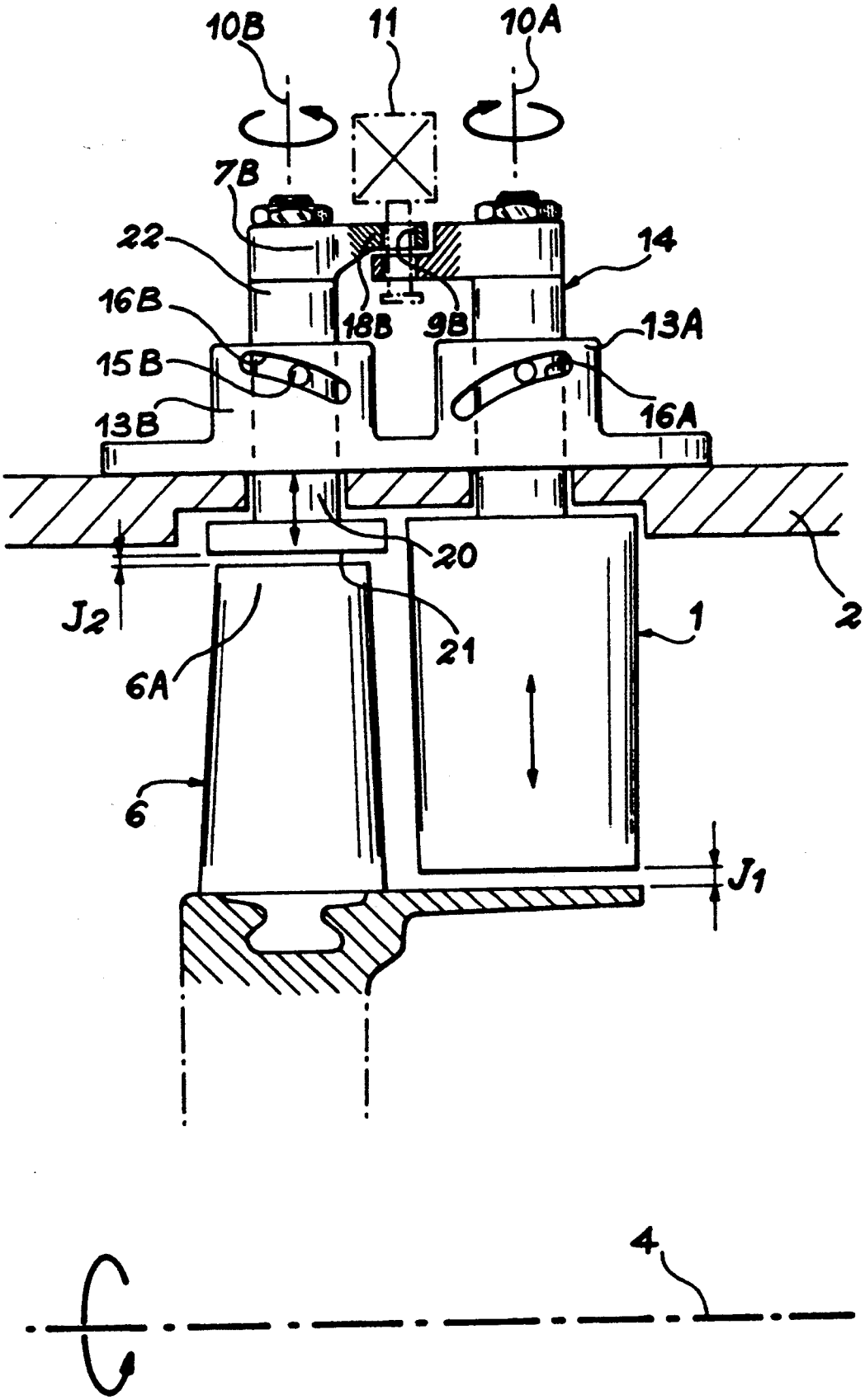
FIG. 3 is a partial cutaway view of a variant of the turbomachine of the invention.

With reference to FIG. 3, a variant of the turbomachine of the invention provides for the adjustment of the play J2 existing between the free extremity 6A of the blades 6 of the rotor and one surface of the stator 2. To this effect, an adjustable stop 20 is installed, one lower extremity of said stop 21 opening from the stator 2 opposite the extremities 6A of the blades 6.

This stop is mounted sliding inside a second bush 13B similar to the first bush 13A. In fact, it includes a hole in which the stop 20 is mounted sliding. This second bush 13B also has groove 16B of the same type as that of the first grooves 16A of the first bush 13A. These second grooves 16B may therefore each be a helical groove portion in the bush 13B. Slugs 15B integral with the stop 20 and perpendicular to the sliding spindle 10B of the stop 20 are each introduced into groove 16B. Thus, a rotation of the stop 20 provokes a displacement of the latter and a moving away or drawing nearer of its extremity surface 21 with respect to the blades 6A. The second play J2 is therefore adjustable.

Adjustment is obtained by fitting the other extremity 22, that is the upper extremity, of the stop 20 with a second crank 7B able to receive at its other extremity 18B the control spindle 12 of the control means. Mounting is similar to that described on FIG. 2, that is the control spindle 12 is able to slide and rotate inside the hole 9B.

In this embodiment, the first crank referenced 7A on FIG. 2, has been rotated so as to be placed also on the sole control spindle 12. In this manner way, the control means 11 are able to simultaneously control the adjustment of the two plays J1 and J2 via a single maneuver. In this respect, it is to be noted that the second grooves 16B have been slanted in a direction opposite the direction in which the first grooves 16A are slanted. Owing to this, the spindle 14 and the stop 20 rotate in opposite directions in their respective bushes 13A and 13B.

The slanting of the grooves 16A and 16B depends on the plays J1 and J2 to be obtained at the extremities of the stators 1 and the blades 6.

This variant is merely one possible embodiment for obtaining the simultaneous adjustment of the plays J1 and J2 at the extremities of the stators 1 and the blades 6 the rotor.

The invention is thus particularly applicable to the stators 1 mounted projecting onto the stator 2, that is via a single extremity. It is to be noted that this same play could be adjusted when stators are mounted via their two extremities.

What is claimed is:

1. A turbomachine, which comprises:

at least one axial compressor equipped with a plurality of first compression stages formed by a rotor having a plurality of blades which are rotatable about a spin axis and a stator having a plurality of blades which have an orientation which is adjustable by rotation of each of said stator blades around a spin axis perpendicular to and intersecting with the spin axis of the rotor, wherein an extremity of the rotor blades is located so as to be separated from the rotor by a first distance;

a mechanism connected to the stator blades for adjusting the first distance between the stator blades and the rotor in accordance with a phase angle of orientation of the stator blades wherein the mechanism for adjusting the first distance comprises a spindle connected to the stator blades and wherein said spindle is pivotable with respect to the stator by a first bush connected to the stator and a first crank connected to the spindle;

said first bush having a groove formed therein wherein said groove is oblique with respect to a spin axis of the stator blades; and a slug integral with the spindle and which both extends perpendicular to the spin axis of the stator blades and is positioned in the groove of the first bush so that rotation of the first crank causes longitudinal movement of the stator blade along the spin axis of the stator blade.

2. A turbomachine according to claim 1, wherein the first crank has a link hole at one extremity thereof within which the spindle is positioned to control rotational movement of the first crank.

3. A turbomachine according to claim 2, wherein an extremity of each blade of the rotor is located separate from the stator by a second distance and wherein a mechanism is provided on the stator for adjusting the second distance between the rotor blades and the stator.

4. A turbomachine according to claim 3, wherein the mechanisms for adjusting the second distance comprises:

a second bush connected with the stator and having groove which is oblique with respect to the axis of a hole formed in the second bush;

a stop slidingly mounted in the hole of the second bush; and a slug positioned perpendicular to the axis of the hole in the second bush which penetrates into the groove of the second bush wherein a lower extremity of the stop is located opposite each rotor blade and wherein a second crank having a hole is located at an opposite extremity of the stop, the hole of the second crank being connected with the control spindle of the control mechanism for moving the lower extremity of the stop toward and away from the rotor blade so as to adjust the second distance between a lower extremity of the stop and a free extremity of the rotor blade.

* * * * *